US011488538B1

(12) United States Patent
Lin et al.

(10) Patent No.: US 11,488,538 B1
(45) Date of Patent: Nov. 1, 2022

(54) DISPLAY GATE DRIVERS FOR GENERATING LOW-FREQUENCY INVERTED PULSES

(71) Applicant: Apple Inc., Cupertino, CA (US)

(72) Inventors: Chin-Wei Lin, San Jose, CA (US); Shinya Ono, Santa Clara, CA (US); Gihoon Choo, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/213,041

(22) Filed: Mar. 25, 2021

Related U.S. Application Data

(60) Provisional application No. 63/033,024, filed on Jun. 1, 2020.

(51) Int. Cl.
*G09G 3/3266* (2016.01)

(52) U.S. Cl.
CPC ..... *G09G 3/3266* (2013.01); *G09G 2310/061* (2013.01); *G09G 2330/028* (2013.01); *G09G 2330/08* (2013.01)

(58) Field of Classification Search
None
See application file for complete search history.

(56) References Cited

U.S. PATENT DOCUMENTS

| | | | | |
|---|---|---|---|---|
| 8,937,489 | B2 | 1/2015 | Park et al. | |
| 9,319,036 | B2 | 4/2016 | Chang et al. | |
| 9,805,657 | B2 | 10/2017 | Kwon et al. | |
| 10,692,437 | B2 | 6/2020 | Liu | |
| 2012/0169954 | A1* | 7/2012 | Liu | G09G 3/3614 349/38 |
| 2016/0005359 | A1* | 1/2016 | Kwon | G09G 3/3266 345/213 |
| 2016/0260378 | A1* | 9/2016 | Tsuge | G09G 3/3233 |
| 2018/0348959 | A1* | 12/2018 | Lin | G09G 3/3659 |

* cited by examiner

*Primary Examiner* — Chad M Dicke
(74) *Attorney, Agent, or Firm* — Treyz Law Group, P.C.; Jason Tsai

(57) ABSTRACT

A display is provided that includes an array of display pixels that receive data signals from display driver circuitry and that receive control signals from gate driver circuitry. The gate driver circuitry may include a chain of row driver circuits. Each row driver circuit may include a scan driver circuit and a scan inverter circuit. An enable transistor may be interposed between the scan driver circuit and the scan inverter circuit and may be selectively disabled to decouple the scan inverter circuit from the scan driver circuit to allow the scan inverter circuit to operate independent from the scan driver circuit. The scan inverter circuit may include a transistor that receives a scan pulse signal from the scan driver circuit and may further include additional transistors connected in a negative feedback configuration to reduce a drain-to-source voltage across the transistor to reduce leakage across the transistor during blanking times.

18 Claims, 13 Drawing Sheets

DISPLAY GATE DRIVERS FOR GENERATING LOW-FREQUENCY INVERTED PULSES

This application claims the benefit of provisional patent application No. 63/033,024, filed Jun. 1, 2020, which is hereby incorporated by reference herein in its entirety.

BACKGROUND

This relates generally to electronic devices with displays and, more particularly, to display driver circuitry for displays such as organic-light-emitting diode displays.

Electronic devices often include displays. For example, cellular telephones and portable computers include displays for presenting information to users.

Displays such as organic light-emitting diode displays have an array of display pixels based on light-emitting diodes. In this type of display, each display pixel includes a light-emitting diode and thin-film transistors for controlling application of a signal to the light-emitting diode to produce light.

The display includes row driver circuits configured to output control signals to the thin-film transistors within each display pixel. The row driver circuits generate one or more scan control signals and emission control signals for selectively enabling and disabling the thin-film transistors during different phases of operation of the display pixels. In low refresh rate displays, the row driver circuits need to output a low voltage signal during blanking times. In practice, however, one or more leakage paths within the row driver circuits may cause the low voltage signal to be inadvertently driven high. It is within this context that the embodiments herein arise.

SUMMARY

An electronic device may include a display having an array of display pixels. The display pixels may receive data signals from display driver circuitry and may receive control signals (e.g., row control signals) from gate driver circuitry. The gate driver circuitry may include a chain of gate driver circuits.

Each gate driver circuit may include a scan driver circuit and a scan inverter circuit. The scan driver circuit may be configured to generate a scan signal, whereas the scan inverter circuit may be configured to receive the scan signal from the scan driver circuit and generate a corresponding inverted scan signal to a row of display pixels in the array.

The scan inverter circuit may include first, second, third, and fourth transistors coupled in series between a high power supply line and a low power supply line. The first and second transistors may have gate terminals configured to receive the scan signal from the scan driver circuit. The third and fourth transistors have gate terminals configured to receive the same clock signal.

The scan inverter circuit may further include a leakage reduction circuit having a first terminal connected to a source terminal of the second transistor and a second terminal connected to the low power supply terminal. In one suitable arrangement, the leakage reduction circuit has a third terminal connected to a drain terminal of the second transistor. In another suitable arrangement, the leakage reduction circuit has a third terminal connected to an output port of the scan inverter circuit. In yet another suitable arrangement, the leakage reduction circuit has a third terminal connected to a drain terminal of the second transistor and a fourth terminal connected to an output port of the scan inverter circuit.

An enable transistor may optionally be coupled between the scan driver circuit and the scan inverter circuit. The enable transistor may be turned on during a first scan mode when the scan driver circuit and the scan inverter circuit operate at the same frequency and may be turned off in a second scan mode when the scan driver circuit and the scan inverter circuit operate independently at different frequencies.

DETAILED DESCRIPTION

Figure 1:
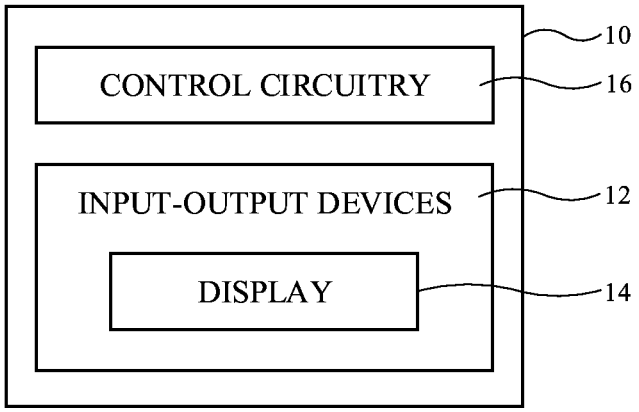
FIG. 1 is a diagram of an illustrative electronic device having a display in accordance with an embodiment.

An illustrative electronic device of the type that may be provided with a display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14 using an array of pixels in display 14.

Device 10 may be a tablet computer, laptop computer, a desktop computer, a display, a cellular telephone, a media player, a wristwatch device or other wearable electronic equipment such as a head-mounted device, or other suitable electronic device.

Display 14 may be an organic light-emitting diode display or may be a display based on other types of display technology. Configurations in which display 14 is an organic light-emitting diode display are sometimes described herein as an example. This is, however, merely illustrative. Any suitable type of display may be used in device 10, if desired.

Display 14 may have a rectangular shape (i.e., display 14 may have a rectangular footprint and a rectangular peripheral edge that runs around the rectangular footprint) or may have other suitable shapes. Display 14 may be planar or may have a curved profile.

Figure 2:
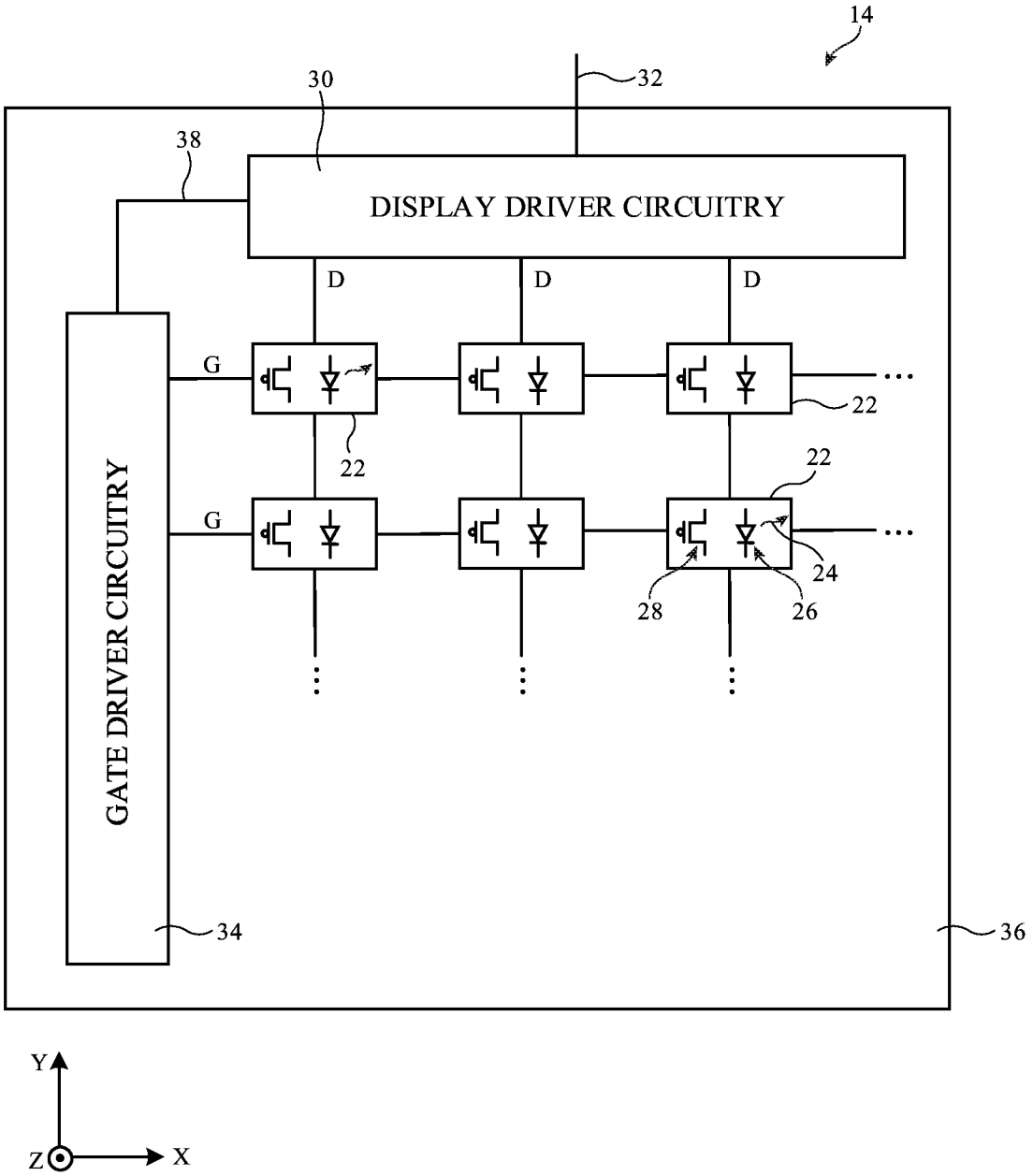
FIG. 2 is a diagram of an illustrative display having an array of organic light-emitting diode display pixels in accordance with an embodiment.

A top plan view of a portion of display 14 is shown in FIG. 2. As shown in FIG. 2, display 14 may have an array of pixels 22 formed on substrate 36. Substrate 36 may be formed from glass, metal, plastic, ceramic, or other substrate materials. Pixels 22 may receive data signals over signal paths such as data lines D and may receive one or more control signals over control signal paths such as horizontal control lines G (sometimes referred to as gate lines, scan lines, emission control lines, etc.). There may be any suitable number of rows and columns of pixels 22 in display 14 (e.g., tens or more, hundreds or more, or thousands or more). Each pixel 22 may have a light-emitting diode 26 that emits light 24 under the control of a pixel control circuit formed from thin-film transistor circuitry such as thin-film transistors 28 and thin-film capacitors). Thin-film transistors 28 may be polysilicon thin-film transistors, semiconducting-oxide thin-film transistors such as indium zinc gallium oxide transistors, or thin-film transistors formed from other semiconductors. Pixels 22 may contain light-emitting diodes of different colors (e.g., red, green, and blue) to provide display 14 with the ability to display color images.

Display driver circuitry may be used to control the operation of pixels 22. The display driver circuitry may be formed from integrated circuits, thin-film transistor circuits, or other suitable electronic circuitry. Display driver circuitry 30 of FIG. 2 may contain communications circuitry for communicating with system control circuitry such as control circuitry 16 of FIG. 1 over path 32. Path 32 may be formed from traces on a flexible printed circuit or other cable. During operation, the control circuitry (e.g., control circuitry 16 of FIG. 1) may supply circuitry 30 with information on images to be displayed on display 14.

To display the images on display pixels 22, display driver circuitry 30 may supply image data to data lines D (e.g., data lines that run down the columns of pixels 22) while issuing clock signals and other control signals to supporting display driver circuitry such as gate driver circuitry 34 over path 38. If desired, circuitry 30 may also supply clock signals and other control signals to gate driver circuitry 34 on an opposing edge of display 14 (e.g., the gate driver circuitry may be formed on more than one side of the display pixel array).

Gate driver circuitry 34 (sometimes referred to as horizontal line control/driver circuitry or row control/driver circuitry) may be implemented as part of an integrated circuit and/or may be implemented using thin-film transistor circuitry. Horizontal/row control lines G in display 14 may carry gate line signals (scan line signals), emission enable control signals, and other horizontal control signals for controlling the pixels of each row. There may be any suitable number of horizontal control signals per row of pixels 22 (e.g., one or more row control lines, two or more row control lines, three or more row control lines, four or more row control lines, five or more row control lines, etc.).

Figure 3:
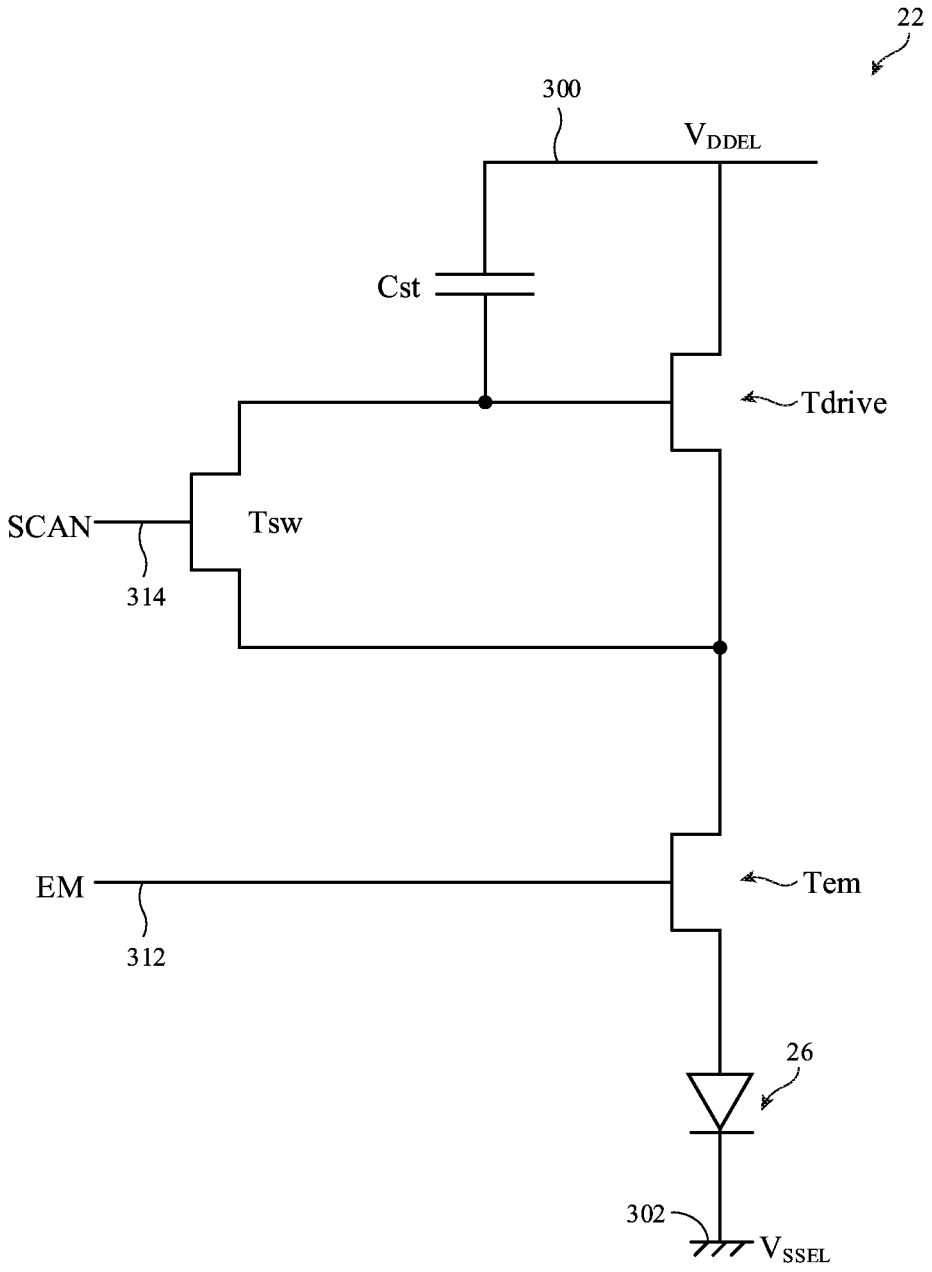
FIG. 3 is a circuit diagram of an illustrative display pixel in accordance with an embodiment.

FIG. 3 is a circuit diagram of an illustrative organic light-emitting diode display pixel 22 in display 14. As shown in FIG. 3, display pixel 22 may include an organic light-emitting diode 26, a storage capacitor Cst and associated pixel transistors such as a drive transistor Tdrive, a switching transistor Tsw, and an emission transistor Tem. Any number of these transistors may be implemented as a semiconducting-oxide transistor (e.g., a transistor with an n-type channel formed from semiconducting oxide such as indium gallium zinc oxide or IGZO) or as a silicon transistor (e.g., a transistor with a polysilicon channel deposited using a low temperature process, sometimes referred to as "LTPS" or low-temperature polysilicon transistor). In particular, switching transistor Tsw may be implemented as a semiconducting-oxide transistor (sometimes referred to as an oxide transistor). Semiconducting-oxide transistors exhibit relatively lower leakage than silicon transistors, so implementing switching transistor Tsw as a semiconducting-oxide transistor will help reduce flicker (e.g., by preventing current from leaking away from the gate terminal of the drive transistor Tdrive).

In the example of FIG. 3, the drive transistor Tdrive, emission transistor Tem, and diode 26 may be coupled in series between power supply terminals 300 and 302. A positive power supply voltage VDDEL may be supplied to positive power supply terminal 300, whereas a ground power supply voltage VSSEL may be supplied to ground power supply terminal 302. Positive power supply voltage VDDEL may be 3 V, 4 V, 5 V, 6 V, 7 V, 2 to 8 V, more than 10 V, or any suitable positive power supply voltage level. Ground power supply voltage VSSEL may be 0 V, −1 V, −2 V, −3 V, −4 V, −5 V, −6V, −7 V, less than −10 V, or any suitable ground or negative power supply voltage level. The state of drive transistor Tdrive controls the amount of current flowing from terminal 300 to terminal 302 through diode 226 and therefore controls the amount of emitted light from display pixel 22.

Control signals from display driver circuitry such as row driver circuitry 34 of FIG. 2 are supplied to control terminals such as row control terminals 312 and 314. Row control terminal 312 may serve as an emission control terminal (sometimes referred to as an emission line or emission control line), whereas row control terminal 314 may serve as a scan control terminal (sometimes referred to as a scan line or scan control line). Emission control signal EM may be supplied to terminal 312. Emission control signal EM can be asserted to turn on transistor Tem during an emission phase to allow current to flow from the drive transistor Tdrive down to light-emitting diode 26. Scan control signal SCAN may be applied to scan terminal 314. Asserting signal SCAN may turn on transistor Tsw, which connects the gate and drain terminals of transistor Tdrive. Deasserting signal SCAN will turn off transistor Tsw, which decouples the gate and drain terminals of transistor Tdrive. During a data loading phase, a data signal can be loaded onto the storage capacitor Cst (e.g., using a separate data loading transistor, not shown). Image data that is loaded into pixel 22 can be at least be partially stored on pixel 22 by using capacitor Cst to hold charge throughout the emission phase.

The pixel structure of FIG. 3 is mere illustrative and is not intended to limit the scope of the present embodiments. If desired, pixel 22 may include more or less than three thin-film transistors (e.g., including one or more additional emission transistor, initialization transistor, data loading transistor, anode reset transistor, etc.) and/or may include more or less than one capacitor.

Figure 9:
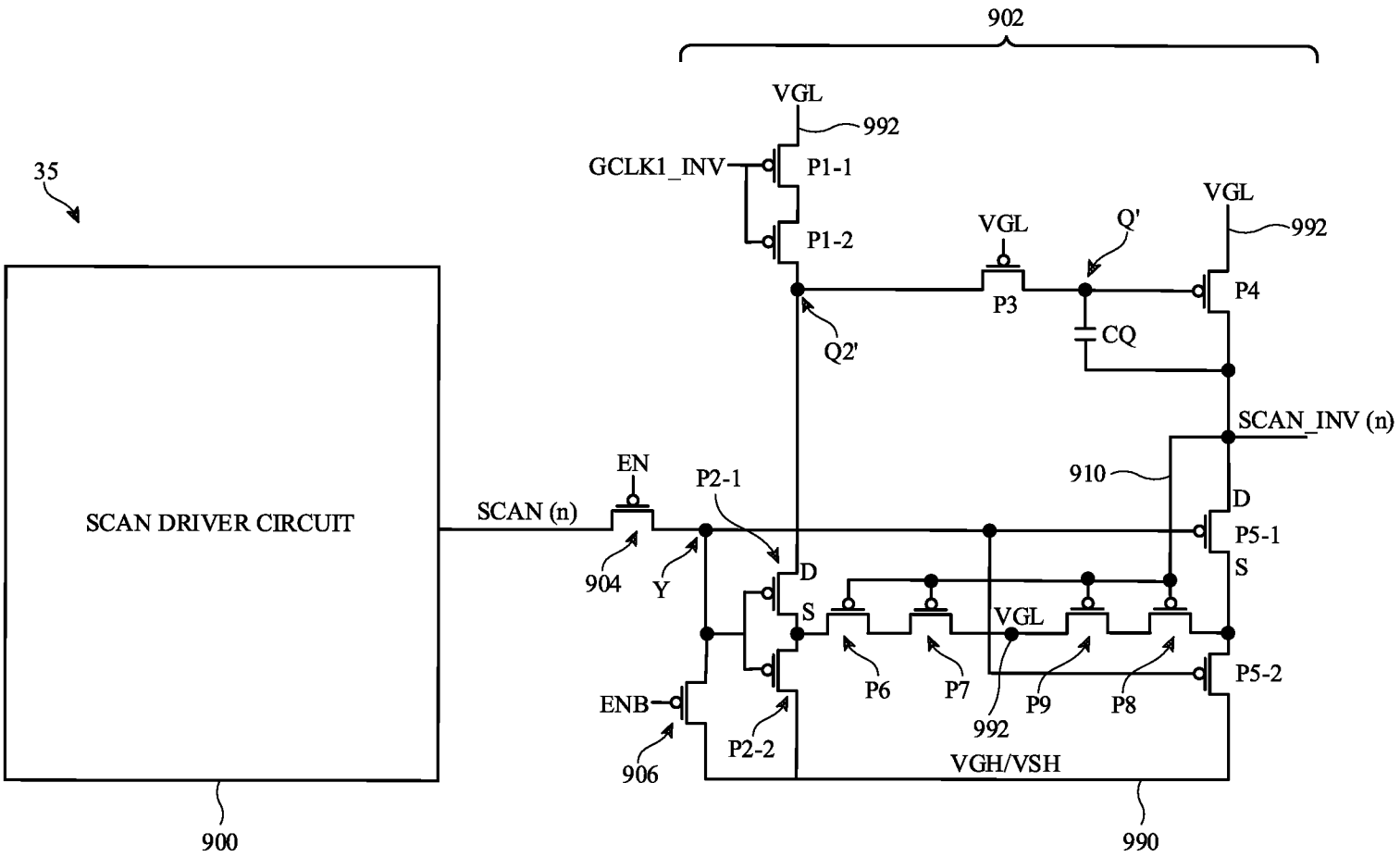

Display 14 may optionally be configured to support low refresh rate operation. Operating display 14 using a relatively low refresh rate (e.g., a refresh rate of 1 Hz, less than 1 Hz, 2 Hz, 1-10 Hz, less than 30 Hz, less than 60 Hz, or other suitable low frequency) may be suitable for applications outputting content that is static or nearly static and/or for applications that require minimal power consumption. FIG. 9 is a diagram of a low refresh rate display driving scheme in accordance with an embodiment. As shown in FIG. 9, display 14 may alternate between a short data refresh period (as indicated by period T_refresh) and an extended blanking period (as indicated by period T_blank). As an example, each data refresh period T_refresh may be approximately 16.67 milliseconds (ms) in accordance with a 60 Hz data refresh operation, whereas each blanking period T_blank may be approximately 1 second so that the overall refresh rate of display 14 is lowered to 1 Hz. Configured as such, duration T_blank can be adjusted to tune the overall refresh rate of display 14. For example, if the duration of T_blank were tuned to half a second, the overall refresh rate would be increased to approximately 2 Hz. In the embodiments described herein, T_blank may be at least two times, at least ten times, at least 30 times, or at least 60 times longer in duration than T_refresh (as examples).

Figure 5:
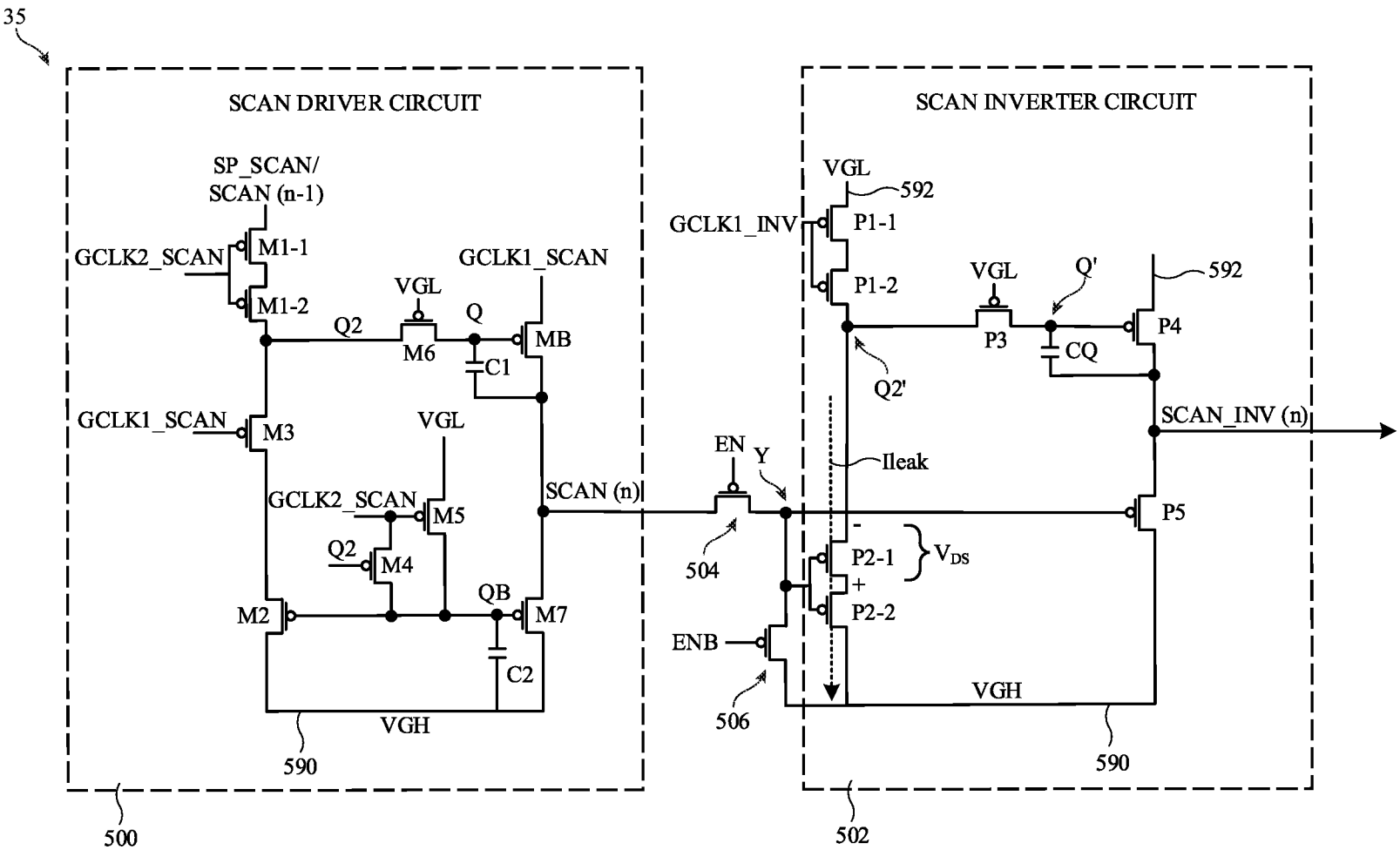
FIG. 5 is a circuit diagram of an illustrative gate driver circuit in accordance with an embodiment.

FIG. 5 is a circuit diagram of a gate driver circuit 35 for generating a row control signal such as a scan signal. Multiple gate driver circuits 35 may be coupled together in a chain to form parts of gate driver circuitry 34 in FIG. 2. As shown in FIG. 5, gate driver circuit 35 may include a first gate driver stage such as scan driver circuit 500 and a second gate driver stage such as scan inverter circuit 502.

Scan driver circuit 500 may include thin-film transistors such as transistors M1-1, M1-2, and M2-8. Transistors M1-1 and M1-2 may be coupled in series between node Q2 and a terminal configured to receive the scan signal output from one of the previous gate driver circuit in the chain (e.g., signal SCAN(n-1) from the preceding gate driver row) or to receive a scan driver start pulse signal SP_SCAN. Transistors M1-1 and M1-2 may have gate terminals configured to receive a scan driver gate clock signal GCLK2_SCAN.

Transistors M2 and M3 are coupled in series between node Q2 and a high power supply terminal 590 (e.g., a positive power supply line on which positive power supply voltage VGH is provided). For example, power supply voltage VGH may be 5 V, 10 V, 15 V, 20 V, 5-15 V, more than 15 V, or other suitable high voltage level. Transistor M3 may have a gate terminal configured to receive another scan driver gate clock signal GCLK1_SCAN. Transistor M2 may have a gate terminal connected to node QB, which is complementary to node Q.

Transistors M7 and M8 are coupled in series between a node configured to receive signal GLK1_SCAN and power supply line 590. Transistor M8 has a gate terminal at node Q, which is coupled to node Q2 via transistor M6. Transistor M6 has a gate terminal configured to receive low power supply voltage VGL. For example, power supply voltage VGL may be 0 V, −5 V, −10 V, −15 V, −20 V, negative 5-15 V, less than 15 V, +1 V, +2 V, or other suitable low voltage level. Capacitor C1 may be coupled across the gate and source terminals of transistor M8. Transistor M7 may have a gate terminal connected to node QB. Capacitor C2 may be coupled across the gate and source terminals of transistor M7. A scan driver circuit output signal SCAN(n) may be provided at the node interposed between transistors M7 and M8. The terms "source" and "drain" terminals of a transistor may sometimes be used interchangeably.

Transistor M5 may have a source terminal configured to receive low voltage VGL, a drain terminal connected to node QB, and a gate terminal configured to receive clock signal GCLK2_SCAN. Transistor M4 may have a first source-drain terminal configured to receive signal GCLK2_SCAN, a second source-drain terminal connected to node QB, and a gate terminal connected to node Q2.

Scan inverter circuit 502 may be configured to invert the signal SCAN(n) generated at the output of circuit 500 to generate a corresponding inverted output SCAN_INV(n). Scan inverter circuit 502 may include thin-film transistors such as transistors P1-1, P1-2, P2-1, P2-2, and P3-P5. Transistors P1-1 and P1-2 may be coupled in series between low power supply line 592 (e.g., a low power supply terminal on which VGL is provided) and node Q2'. Transistors P1-1 and P1-2 may have gate terminals configured to receive a scan inverter gate clock signal GCLK1_INV.

Transistors P2-1 and P2-2 may be coupled in series between node Q2' and power supply terminal 590. Transistors P2-1 and P2-2 may have gate terminals that are shorted together and connected to node Y. Node Y may be configured to selectively receive the SCAN(n) signal output from scan driver circuit 500.

Transistors P4 and P5 may be coupled in series between low power supply terminal 592 and high power supply terminal 590. Transistor P4 may have a gate terminal at node Q', which is coupled to node Q2' via transistor P3. Transistor P3 has a gate terminal configured to receive low power supply voltage VGL. Capacitor CQ may be coupled across the gate and source terminals of transistor P4. Transistor P5 may have a gate terminal connected to node Y. The scan inverter circuit output signal SCAN_INV(n) may be provided at the node interposed between transistors P4 and P5.

In accordance with an embodiment, a mode switching transistor such as transistor 504 may be coupled between scan driver circuit 500 and scan inverter circuit 502. In the example of FIG. 5, transistor 504 may have a first source-drain terminal configured to receive signal SCAN(n) from the output of scan driver circuit 500, a second source-drain terminal coupled to node Y, and a gate terminal configured to receive an enable signal EN. Moreover, an auxiliary transistor such as transistor 506 may have a first source-drain terminal connected to node Y, a second source-drain terminal connected to power supply line 590, and a gate terminal configured to receive an inverted version of the of enable signal (e.g., signal ENB). Transistor 504 may therefore sometimes be referred to as an enable transistor.

Figure 6:
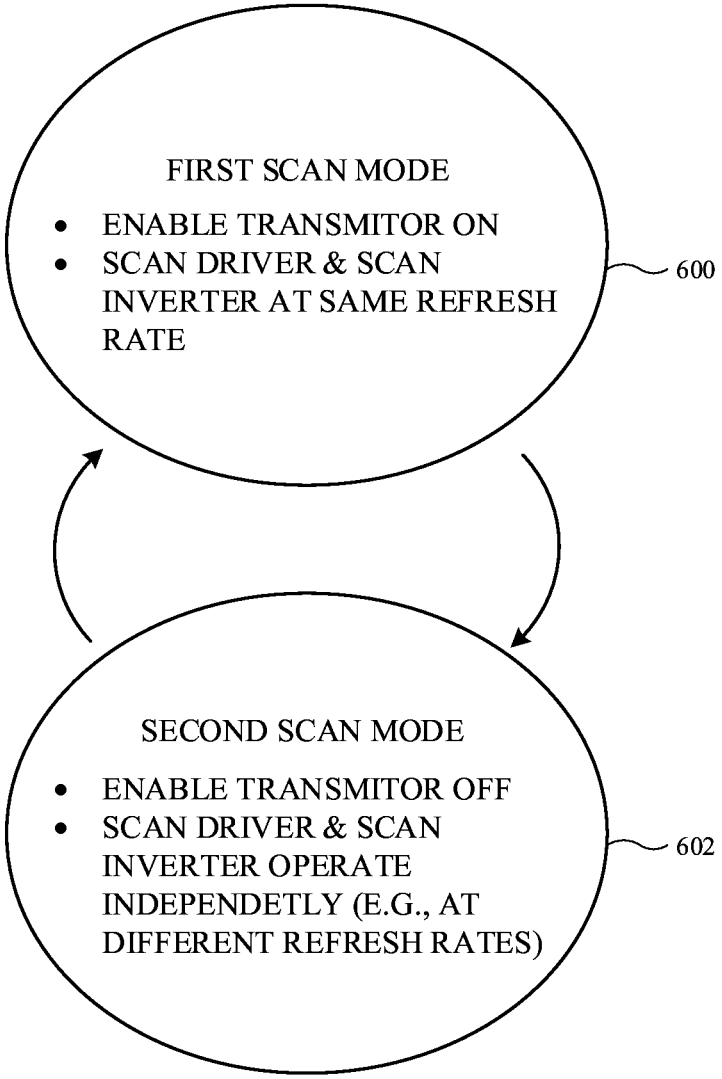
FIG. 6 is a diagram showing illustrative scan driver modes in accordance with an embodiment.

The use of transistors 504 and 506 enable gate driver circuit 35 to be operated in at least two different modes, as illustrated in FIG. 6. As shown in FIG. 6, gate driver circuit may be operable in a first scan mode 600 and a second scan mode 602. When configured in the first scan mode 600, the enable transistor 504 is turned on by asserting signal EN (e.g., by driving signal EN low assuming transistor 504 is a p-type transistor). Driving signal EN low to turn on transistor 504 will force inverted signal ENB high, which turns off auxiliary p-type transistor 506. This enables the scan driver circuit 500 and the scan inverter circuit 502 to be coupled together and operable at the same refresh rate or at the same operating frequency. For example, scan driver circuit 500 outputting SCAN(n) signal pulses at 1 Hz will cause scan inverter circuit 502 to output corresponding SCAN_INV(n) pulses also at 1 Hz.

When configured in the second scan mode 602, the enable transistor 504 is turned off by deasserting signal EN (e.g., by driving signal EN high assuming transistor 504 is a p-type transistor). Driving signal EN high to turn off transistor 504 will force inverted signal ENB low, which turns on auxiliary p-type transistor 506. Activating transistor 506 will pull node Y high, which turns off transistors P5, P2-1, and P2-2. Deactivating transistor 504 decouples the scan driver circuit 500 from the scan inverter circuit 502 and allows them to operate independently at different refresh rates or at different operating frequencies. For example, scan driver circuit 500 might output SCAN(n) signal pulses at 60 Hz while scan inverter circuit 502 output SCAN_INV(n) signal pulses at a much lower rate of 1 Hz.

The example of FIG. 5 in which scan driver circuit 500 and scan inverter circuit 502 are implemented using only p-type silicon transistors (e.g., p-channel LTPS transistors) is merely illustrative. If desired, scan driver circuit 500 and/or scan inverter circuit 502 may be implemented using only n-type silicon transistors or using only semiconducting-oxide transistors. In yet other suitable arrangements, circuits 500 and 502 might be implemented using some combination of n-type transistors (e.g., n-channel silicon transistors and oxide transistors) and p-type transistors (e.g., p-channel silicon transistors). In general, other suitable ways of implementing scan driver 500 and inverter 502 may also be employed.

Figure 4:
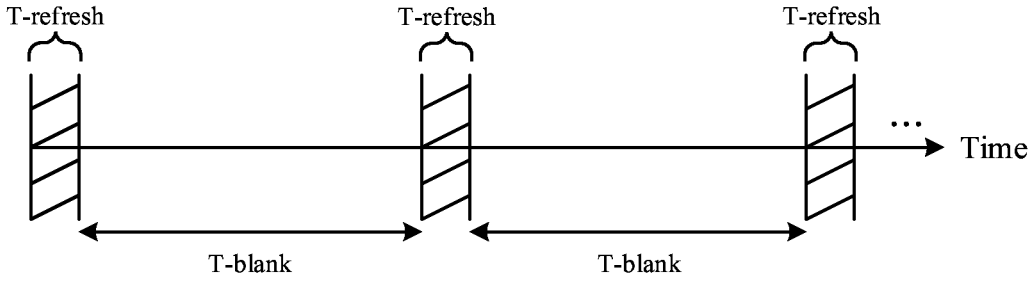
FIG. 4 is a diagram of a low refresh rate display driving scheme in accordance with an embodiment.

In certain embodiments, gate driver circuit 35 may be used to control semiconducting-oxide transistor Tsw of FIG. 3 (e.g., signal SCAN_INV(n) may be fed to the gate terminal of transistor Tsw). Semiconducting-oxide switching transistor Tsw is an n-type/n-channel transistor. During blanking periods T_blank as shown in FIG. 4, signal SCAN_INV(n) should therefore be driven low to keep transistor Tsw off during T_blank. To keep SCAN_INV(n) low during T_blank, node Q' should be low to turn on transistor P4. Thus, node Q2' ought to be kept low as well. Assuming transistor 504 is on, node Y is typically low during blanking times, which turns on transistor P2-2 to pull its drain terminal towards VGH. As a result, transistor P2-1 will see a high drain-to-source voltage $V_{DS}$ across its source-drain terminals (e.g., transistor P2-1 may have a $V_{DS}$ of about VGH-VGL during T_blank). Having a high $V_{DS}$ may risk causing a substantial amount of current to leak through transistor P2-1 (as indicated by leakage current path Ileak), which would undesirably charge up node Q2' and node Q' and could thereby transistor P4 to be turned off. This risk is heightened for low refresh rate displays since the duration of T_blank is extended, which allows more time for the leakage current to discharge node Q2' and Q'.

Figure 7:
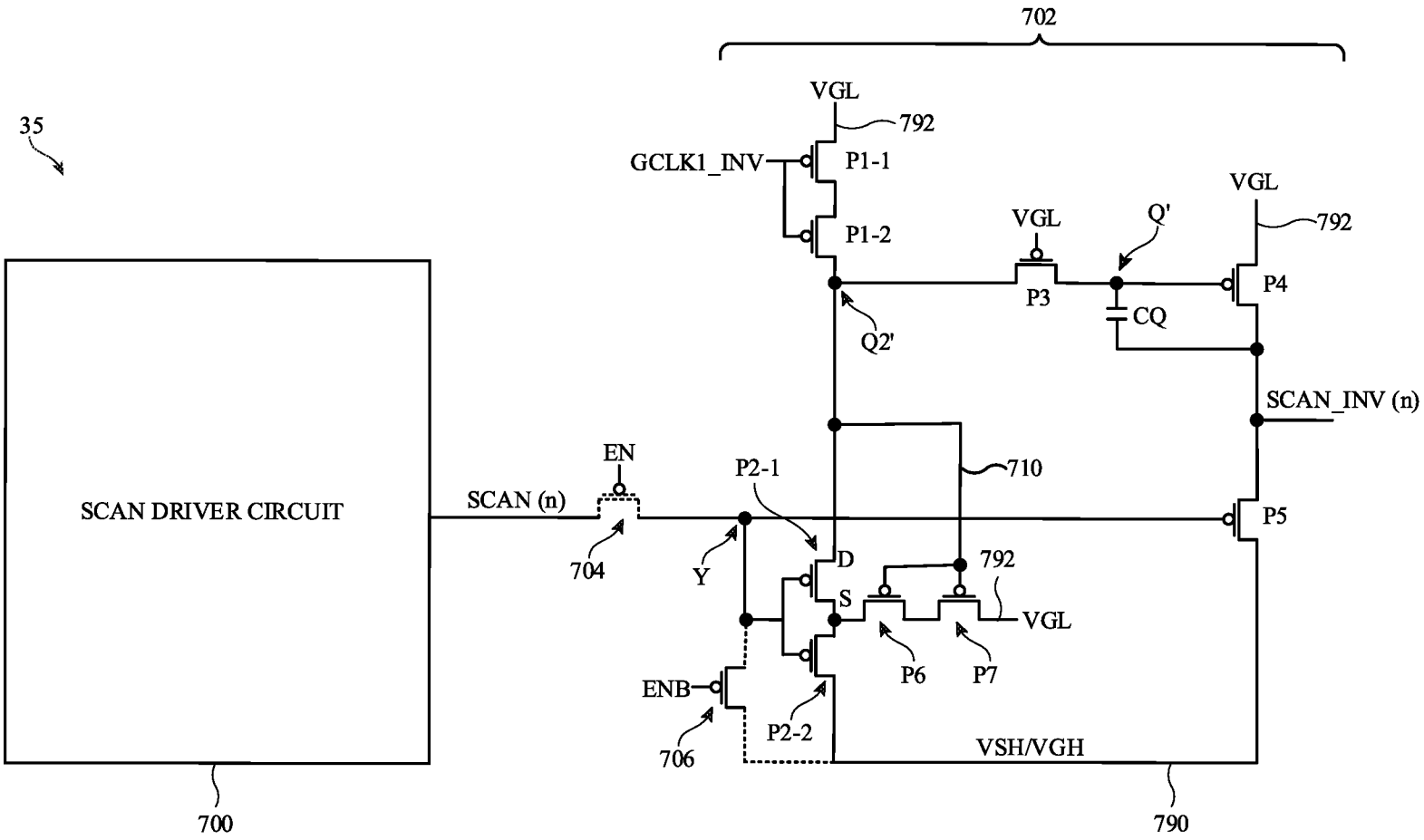
FIGS. 7-10 are circuit diagrams showing various arrangements of a gate driver circuit with reduced leakage in accordance with an embodiment.

In accordance with an embodiment, a gate driver circuit may be provided with additional circuitry configured to reduce the leakage current. FIG. 7 shows one suitable arrangement of gate driver circuit 35 with reduced leakage. As shown in FIG. 7, gate driver 35 may include a first gate driver stage such as scan driver circuit 700 and a second gate driver stage such as scan inverter circuit 702. Scan driver circuit 700 may have the same or similar structure as scan driver circuit 500 of FIG. 5 and need not be reiterated again in detail.

Scan inverter circuit 702 may be configured to invert the signal SCAN(n) generated at the output of circuit 700 to generate a corresponding inverted output SCAN_INV(n). Scan inverter circuit 702 may include thin-film transistors such as transistors P1-1, P1-2, P2-1, P2-2, and P3-P7. Transistors P1-1 and P1-2 may be coupled in series between low power supply line 792 (e.g., a low power supply terminal on which VGL is provided) and node Q2'. Transistors P1-1 and P1-2 may have gate terminals configured to receive scan inverter gate clock signal GCLK1_INV.

Transistors P2-1 and P2-2 may be coupled in series between node Q2' and power supply terminal 790 (e.g., a power supply line on which high power supply voltage VGH or another positive power supply voltage VSH is provided). Power supply voltage VSH may be less than VGH (as an example). Transistors P2-1 and P2-2 may have gate terminals that are shorted together and connected to node Y. Node Y may be configured to selectively receive the SCAN(n) signal output from scan driver circuit 500. Gate driver circuit 35 may optionally be provided with transistors 704 and 706, which can be selectively enabled/disabled to operate circuit 35 in the different scan modes described in connection with FIG. 6.

Transistors P4 and P5 may be coupled in series between low power supply terminal 792 and high power supply terminal 790. Transistor P4 may have a gate terminal at node Q', which is coupled to node Q2' via transistor P3. Transistor P3 has a gate terminal configured to receive low power supply voltage VGL. Capacitor CQ may be coupled across the gate and source terminals of transistor P4. Transistor P5 may have a gate terminal connected to node Y. The scan inverter circuit output signal SCAN_INV(n) may be provided at the node interposed between transistors P4 and P5.

The example of FIG. 7 in which scan inverter circuit 702 is implemented using only p-type silicon transistors (e.g., p-channel LTPS transistors) is merely illustrative. If desired, scan driver circuit 700 and/or scan inverter circuit 502 may be implemented using only n-type silicon transistors or using only semiconducting-oxide transistors. In yet other suitable arrangements, circuits 700 and 702 might be implemented using some combination of n-type transistors (e.g., n-channel silicon transistors and oxide transistors) and p-type transistors (e.g., p-channel silicon transistors). In general, other suitable ways of implementing scan driver 700 and inverter 702 may also be employed.

Furthermore, transistors P6 and P7 may be coupled in series between low power supply line 792 and the node interposed between transistors P2-1 and P2-2. Transistors P6 and P7 may have gate terminals that are connected to node Q2' via connection path 710. As described above, nodes Q' and Q2' should be kept low during blanking times T_blank. If node Q2' is low, transistors P6 and P7 will be turned on to pull the source node of transistor P2-1 down to VGL. As a result, the drain-to-source voltage $V_{DS}$ of transistor P2-1 will be kept low or minimized during blanking times, which will dramatically reduce the amount of leakage current through transistor P2-1. Transistors P6 and P7 connected in this way to suppress leakage may be said to be connected in a "negative feedback" arrangement. Transistors P6 and P7 may therefore sometimes be referred to as a leakage reduction or leakage suppression circuit within scan inverter circuit 702.

Figure 8:
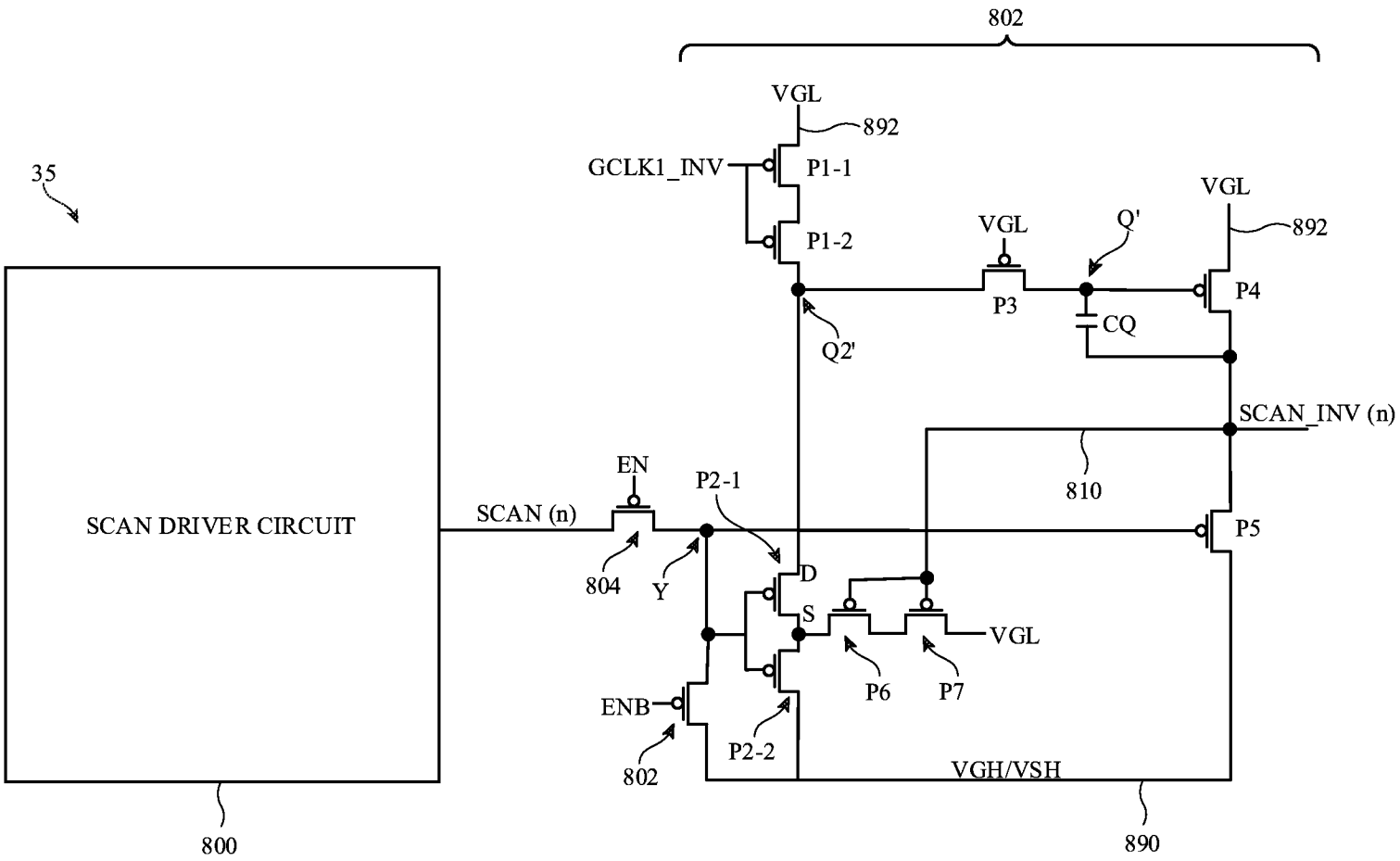

FIG. 8 shows another suitable arrangement of gate driver circuit 35 with reduced leakage. As shown in FIG. 8, gate driver 35 may include a first gate driver stage such as scan driver circuit 800 and a second gate driver stage such as scan inverter circuit 802. Scan driver circuit 800 may have the same or similar structure as scan driver circuit 500 of FIG. 5 and need not be reiterated again in detail.

Scan inverter circuit 802 may be configured to invert the signal SCAN(n) generated at the output of circuit 800 to generate a corresponding inverted output SCAN_INV(n). Scan inverter circuit 802 may include thin-film transistors such as transistors P1-1, P1-2, P2-1, P2-2, and P3-P7. Transistors P1-1 and P1-2 may be coupled in series between low power supply line 892 (e.g., a low power supply terminal on which VGL is provided) and node Q2'. Transistors P1-1 and P1-2 may have gate terminals configured to receive scan inverter gate clock signal GCLK1_INV.

Transistors P2-1 and P2-2 may be coupled in series between node Q2' and power supply terminal 890 (e.g., a power supply line on which high power supply voltage VGH or another positive power supply voltage VSH is provided). Power supply voltage VSH may be less than VGH (as an example). Transistors P2-1 and P2-2 may have gate terminals that are shorted together and connected to node Y. Node Y may be configured to selectively receive the SCAN(n) signal output from scan driver circuit 800. Gate driver circuit 35 may optionally be provided with transistors 804 and 806, which can be selectively enabled/disabled to operate circuit 35 in the different scan modes described in connection with FIG. 6.

Transistors P4 and P5 may be coupled in series between low power supply terminal 892 and high power supply terminal 890. Transistor P4 may have a gate terminal at node Q', which is coupled to node Q2' via transistor P3. Transistor P3 has a gate terminal configured to receive low power supply voltage VGL. Capacitor CQ may be coupled across the gate and source terminals of transistor P4. Transistor P5 may have a gate terminal connected to node Y. The scan inverter circuit output signal SCAN_INV(n) may be provided at the node interposed between transistors P4 and P5.

The example of FIG. 8 in which scan inverter circuit 802 is implemented using only p-type silicon transistors (e.g., p-channel LTPS transistors) is merely illustrative. If desired, scan driver circuit 800 and/or scan inverter circuit 802 may be implemented using only n-type silicon transistors or using only semiconducting-oxide transistors. In yet other suitable arrangements, circuits 800 and 802 might be implemented using some combination of n-type transistors (e.g., n-channel silicon transistors and oxide transistors) and p-type transistors (e.g., p-channel silicon transistors). In general, other suitable ways of implementing scan driver 800 and inverter 802 may also be employed.

Furthermore, leakage reduction/suppression transistors P6 and P7 may be coupled in series between low power supply line 892 and the node interposed between transistors P2-1 and P2-2. Transistors P6 and P7 may have gate terminals that are connected to the scan inverter output node via connection path 810. As described above, node Q' should be kept low during blanking times T_blank. If node Q' is low, transistor P4 will be turned on to pull the scan inverter output node down to VGL. As a result, transistors P6 and P7 will be turned on to pull the source terminal of transistor P2-1 down to VGL, which would minimize the drain-to-source voltage $V_{DS}$ of transistor P2-1, thereby dramatically reducing the amount of leakage current through transistor P2-1 during blanking times. Transistors P6 and P7 may therefore sometimes be referred to as a leakage reduction or leakage suppression circuit within scan inverter circuit 802.

FIG. 9 shows yet another suitable arrangement of gate driver circuit 35 with reduced leakage. As shown in FIG. 9, gate driver 35 may include a first gate driver stage such as scan driver circuit 900 and a second gate driver stage such as scan inverter circuit 902. Scan driver circuit 900 may have the same or similar structure as scan driver circuit 500 of FIG. 5 and need not be reiterated again in detail.

Scan inverter circuit 902 may be configured to invert the signal SCAN(n) generated at the output of circuit 900 to generate a corresponding inverted output SCAN_INV(n). Scan inverter circuit 902 may include thin-film transistors such as transistors P1-1, P1-2, P2-1, P2-2 P3, P4, P5-1, P5-2, and P6-P9. Transistors P1-1 and P1-2 may be coupled in series between low power supply line 992 (e.g., a low power supply terminal on which VGL is provided) and node Q2'. Transistors P1-1 and P1-2 may have gate terminals configured to receive scan inverter gate clock signal GCLK1_INV.

Transistors P2-1 and P2-2 may be coupled in series between node Q2' and power supply terminal 990 (e.g., a power supply line on which high power supply voltage VGH or another positive power supply voltage VSH is provided). Power supply voltage VSH may be less than VGH (as an example). Transistors P2-1 and P2-2 may have gate terminals that are shorted together and connected to node Y. Node Y may be configured to selectively receive the SCAN(n) signal output from scan driver circuit 900. Gate driver circuit 35 may optionally be provided with transistors 904 and 906, which can be selectively enabled/disabled to operate circuit 35 in the different scan modes described in connection with FIG. 6.

Transistors P4, P5-1, and P5-2 may be coupled in series between low power supply terminal 992 and high power supply terminal 990. Transistor P4 may have a gate terminal at node Q', which is coupled to node Q2' via transistor P3. Transistor P3 has a gate terminal configured to receive low power supply voltage VGL. Capacitor CQ may be coupled across the gate and source terminals of transistor P4. Transistors P5-1 and P5-2 may have gate terminals connected to node Y. The scan inverter circuit output signal SCAN_INV (n) may be provided at the node interposed between transistors P4 and P5-1.

The example of FIG. 9 in which scan inverter circuit 902 is implemented using only p-type silicon transistors (e.g., p-channel LTPS transistors) is merely illustrative. If desired, scan driver circuit 900 and/or scan inverter circuit 902 may be implemented using only n-type silicon transistors or using only semiconducting-oxide transistors. In yet other suitable arrangements, circuits 900 and 902 might be implemented using some combination of n-type transistors (e.g., n-channel silicon transistors and oxide transistors) and p-type transistors (e.g., p-channel silicon transistors). In general, other suitable ways of implementing scan driver 900 and inverter 902 may also be employed.

Furthermore, transistors P6-P7 may be coupled in series between low power supply line 992 and the node interposed between transistors P2-1 and P2-2, whereas transistors P8-P9 may be coupled in series between low power supply line 992 and the node interposed between transistors P5-1 and P5-2. Transistors P6-P9 (collectively referred to as a leakage reduction or leakage suppression circuit) may have gate terminals that are connected to the scan inverter output node via connection path 910. As described above, node Q' should be kept low during blanking times T_blank. If node Q' is low, transistor P4 will be turned on to pull the scan inverter output node down to VGL. As a result, transistors P6-P7 will be turned on to pull the source terminal of transistor P2-1 down to VGL while transistors P7-P8 will be turned on to pull the source terminal of transistor P5-1 down to VGL, which would force the drain-to-source voltage $V_{DS}$ of transistors P2-1 and P5-1 to be low, thereby dramatically reducing the amount of leakage currents flowing through transistors P2-1 and P5-1, respectively. Configured in this way, the leakage currents through both pull-up paths through transistors P2-1 and P5-1 in scan inverter circuit 902 can be reduced. Transistors P6-P9 may therefore sometimes be referred to as a leakage reduction or leakage suppression circuit within scan inverter circuit 902.

Figure 10:
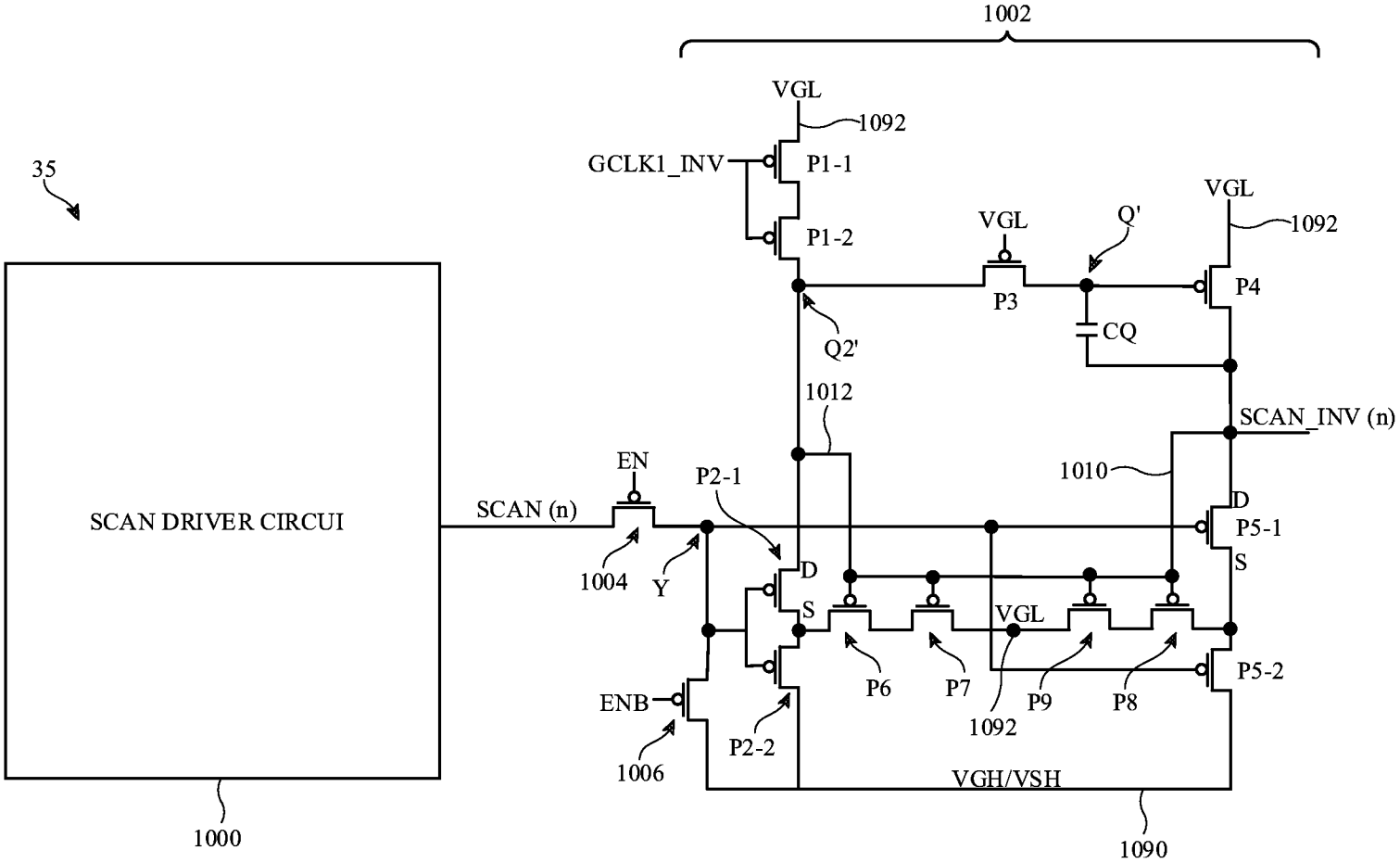

FIG. 10 shows yet another suitable arrangement of gate driver circuit 35 with reduced leakage. As shown in FIG. 10, gate driver 35 may include a first gate driver stage such as scan driver circuit 1000 and a second gate driver stage such as scan inverter circuit 1002. Scan driver circuit 1000 may have the same or similar structure as scan driver circuit 500 of FIG. 5 and need not be reiterated again in detail.

Scan inverter circuit 1002 may be configured to invert the signal SCAN(n) generated at the output of circuit 1000 to generate a corresponding inverted output SCAN_INV(n). Scan inverter circuit 1002 may include thin-film transistors such as transistors P1-1, P1-2, P2-1, P2-2 P3, P4, P5-1, P5-2, and P6-P9. Transistors P1-1 and P1-2 may be coupled in series between low power supply line 1092 (e.g., a low power supply terminal on which VGL is provided) and node Q2'. Transistors P1-1 and P1-2 may have gate terminals configured to receive scan inverter gate clock signal GCLK1_INV.

Transistors P2-1 and P2-2 may be coupled in series between node Q2' and power supply terminal 1090 (e.g., a power supply line on which high power supply voltage VGH or another positive power supply voltage VSH is provided). Power supply voltage VSH may be less than VGH (as an example). Transistors P2-1 and P2-2 may have gate terminals that are shorted together and connected to node Y. Node Y may be configured to selectively receive the SCAN(n) signal output from scan driver circuit 1000. Gate driver circuit 35 may optionally be provided with transistors 1004 and 1006, which can be selectively enabled/disabled to operate circuit 35 in the different scan modes described in connection with FIG. 6.

Transistors P4, P5-1, and P5-2 may be coupled in series between low power supply terminal 1092 and high power supply terminal 1090. Transistor P4 may have a gate terminal at node Q', which is coupled to node Q2' via transistor P3. Transistor P3 has a gate terminal configured to receive low power supply voltage VGL. Capacitor CQ may be coupled across the gate and source terminals of transistor P4. Transistors P5-1 and P5-2 may have gate terminals connected to node Y. The scan inverter circuit output signal SCAN_INV(n) may be provided at the node interposed between transistors P4 and P5-1.

The example of FIG. 10 in which scan inverter circuit 1002 is implemented using only p-type silicon transistors (e.g., p-channel LTPS transistors) is merely illustrative. If desired, scan driver circuit 1000 and/or scan inverter circuit 1002 may be implemented using only n-type silicon transistors or using only semiconducting-oxide transistors. In yet other suitable arrangements, circuits 1000 and 1002 might be implemented using some combination of n-type transistors (e.g., n-channel silicon transistors and oxide transistors) and p-type transistors (e.g., p-channel silicon transistors). In general, other suitable ways of implementing scan driver 1000 and inverter 1002 may also be employed.

Furthermore, transistors P6-P7 may be coupled in series between low power supply line 1092 and the node interposed between transistors P2-1 and P2-2, whereas transistors P8-P9 may be coupled in series between low power supply line 1092 and the node interposed between transistors P5-1 and P5-2. Leakage reducing transistors P6 and P7 may have gate terminals connected to node Q2' via connection path 1012, whereas leakage reducing transistors P8 and P9 may have gate terminals connected to the scan inverter output node via connection path 1010. As described above, nodes Q2' and Q' should be kept low during blanking times T_blank. If node Q' is low, transistor P4 will be turned on to pull the scan inverter output node down to VGL and will also pull node Q2' low as well. As a result, transistors P6-P7 will be turned on to pull the source terminal of transistor P2-1 down to VGL while transistors P7-P8 will be turned on to pull the source terminal of transistor P5-1 down to VGL, which would force the drain-to-source voltage $V_{DS}$ of transistors P2-1 and P5-1 to be low, thereby dramatically reducing the amount of leakage currents flowing through transistors P2-1 and P5-1, respectively. Configured in this way, the leakage currents through both pull-up paths through transistors P2-1 and P5-1 in scan inverter circuit 902 can be reduced. Transistors P6-P9 may therefore sometimes be referred to as a leakage reduction or leakage suppression circuit within scan inverter circuit 1002.

Figure 11:
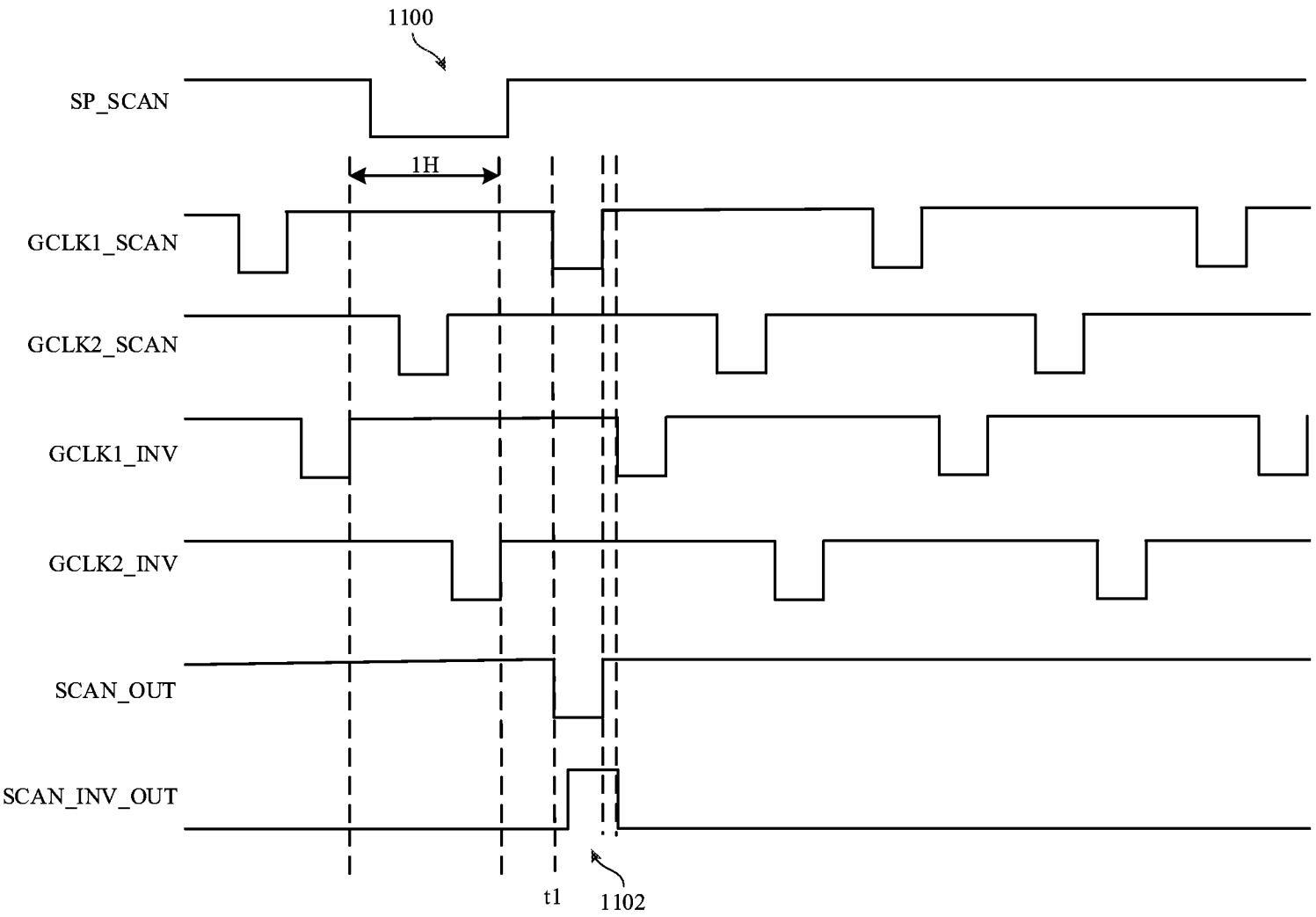
FIG. 11 is a timing diagram showing illustrative waveforms for generating a single scan inverter output pulse in accordance with an embodiment.

FIG. 11 is a timing diagram showing illustrative waveforms for generating a single scan inverter output pulse. These waveforms may be used to control the various gate driver circuits 35 of the type shown in FIGS. 5 and 7-10. As shown in FIG. 11, clock signal GCLK2_SCAN may be a delayed version of clock signal GCLK1_SCAN. Similarly, clock signal GCLK2_INV may be a delayed version of clock signal GCLK1_SCAN. For instance, clock signal GCLK2_INV may be delayed by one row time (1H) with respect to clock signal GCLK1_INV. In the example of FIG. 11, the start pulse signal SP_SCAN that is fed to the chain of gate driver circuits may have a pulse 1100 with a pulse width of one row time 1H, which is used to generate a single SCAN_INV_OUT pulse 1102 at time t1.

Figure 12:
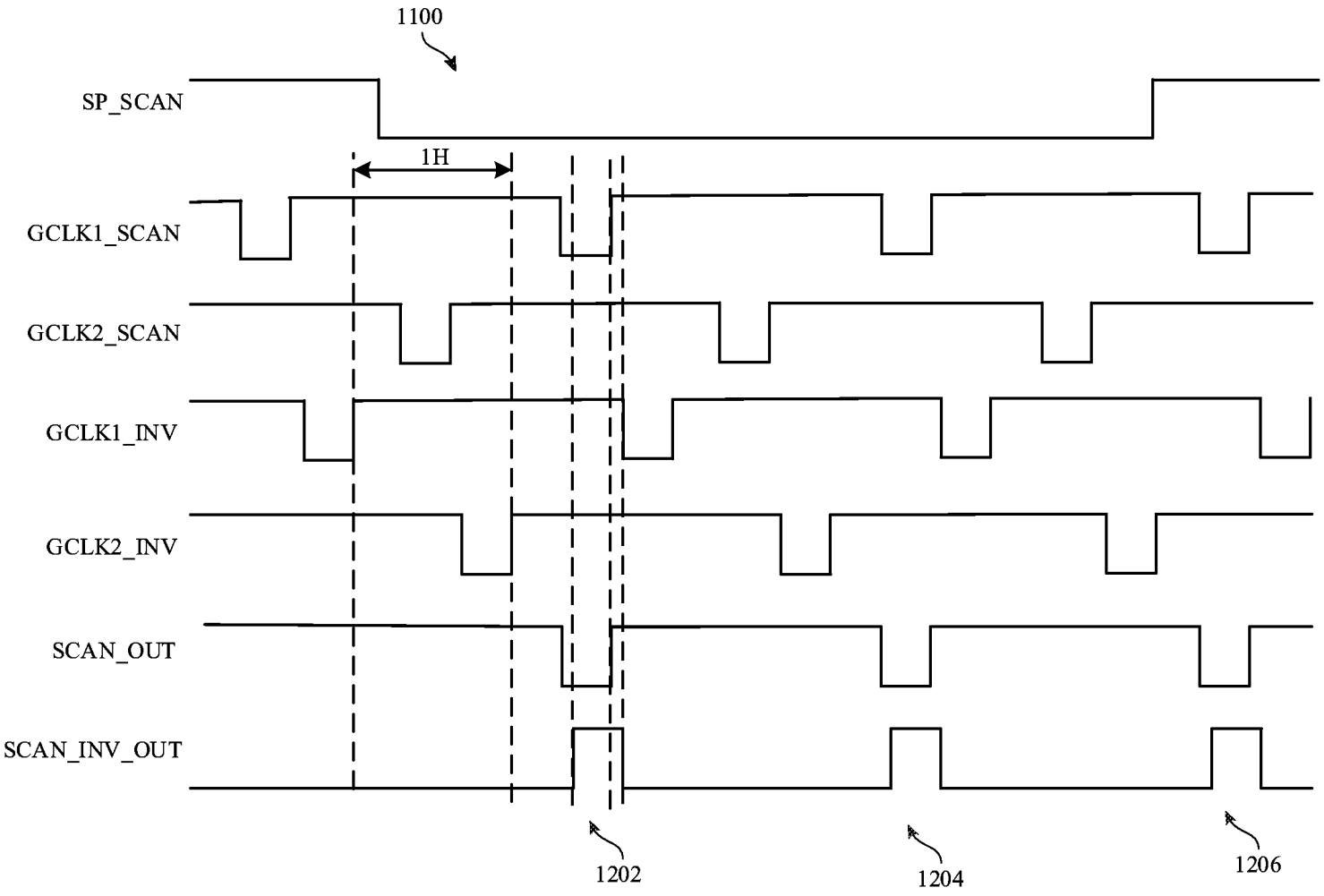
FIG. 12 is a timing diagram showing illustrative waveforms for generating multiple successive inverter output pulses in accordance with an embodiment.

FIG. 12 is a timing diagram showing illustrative waveforms for generating multiple successive scan inverter output pulses. These waveforms may be used to control the various gate driver circuits 35 of the type shown in FIGS. 5 and 7-10. As shown in FIG. 12, clock signal GCLK2_SCAN may be a delayed version of clock signal GCLK1_SCAN. Similarly, clock signal GCLK2_INV may be a delayed version of clock signal GCLK1_SCAN. For instance, clock signal GCLK2_INV may be delayed by one row time (1H) with respect to clock signal GCLK1_INV. In the example of FIG. 12, the start pulse signal SP_SCAN that is fed to the chain of gate driver circuits may have a pulse 1200 with a pulse width that is multiple row times long. Operated in this way, multiple successive SCAN_INV_OUT pulses such as pulses 1202, 1204, and 1206 may be generated as a result.

Figure 13:
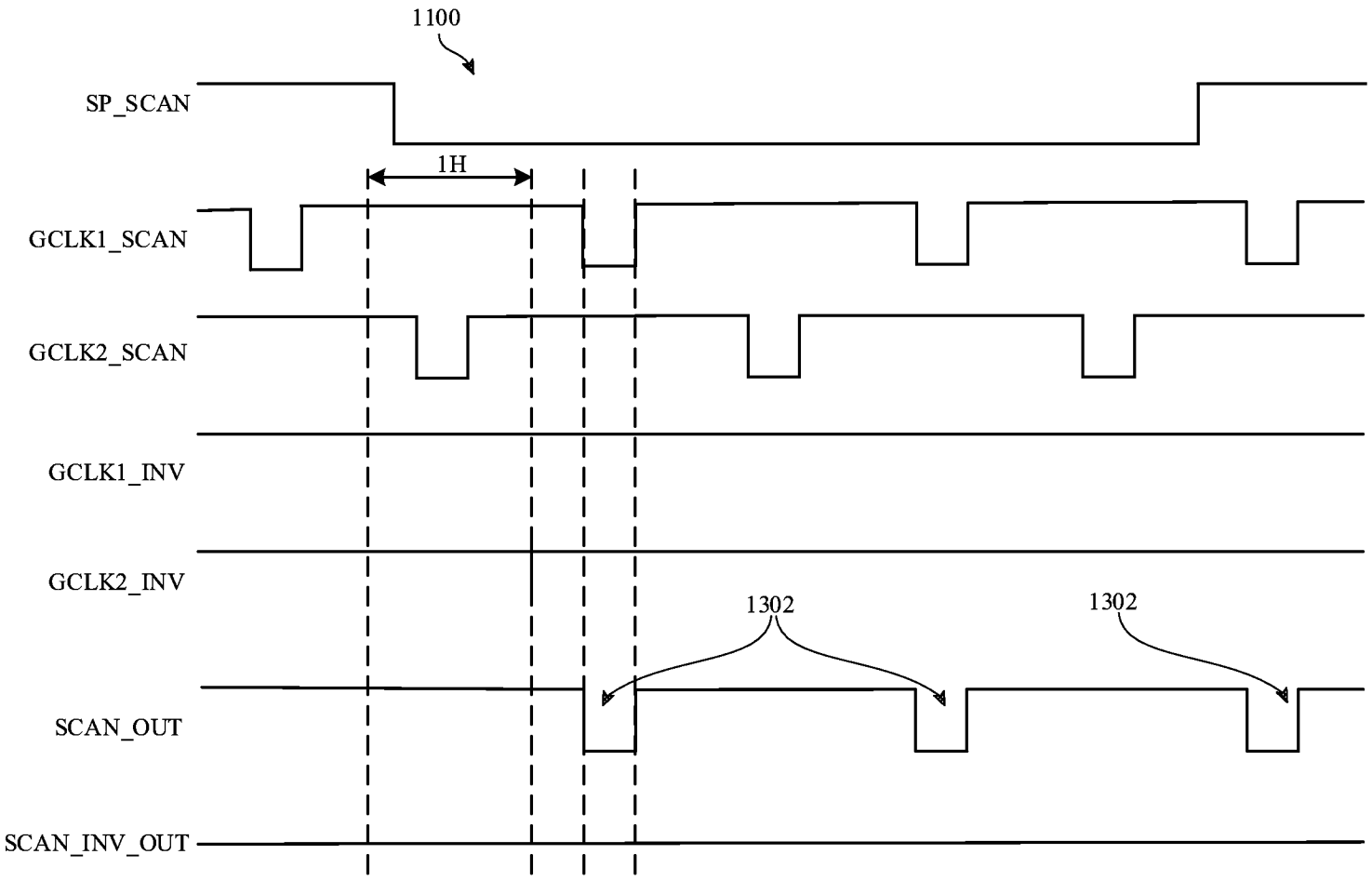
FIG. 13 is timing diagram showing how the scan inverter output pulse can be suppressed in accordance with an embodiment.

FIG. 13 is timing diagram showing how the scan inverter output pulse can be optionally suppressed. These waveforms may be used to control the various gate driver circuits 35 of the type shown in FIGS. 5 and 7-10. In the example of FIG. 13, the enable transistor (see, e.g., transistor 504 of FIG. 5, transistor 704 of FIG. 7, transistor 804 of FIG. 8, transistor 904 of FIG. 9, or transistor 1004 of FIG. 10) may be turned off by deasserting enable control signal EN, which decouples the scan inverter circuit from the scan driver circuit. As described in connection with FIG. 6, turning off the enable transistor may configure the gate driver circuit in the second scan mode 602, which will allow the scan driver circuit and the scan inverter circuit to operate independently. Thus, in the example of FIG. 13, even when the scan driver circuit is generating multiple successive pulses 1302 at some predetermined frequency, the scan inverter circuit may not generate any pulses, as shown by the lack of inverter pulses in SCAN_INV_OUT. In other words, the scan inverter circuit may be used to generate inverter pulses at a much lower frequency than the scan driver circuit by controlling how often the enable transistor is turned on to let through one or more pulses from in SCAN_OUT. When the enable transistor is off, the inverter clock signals GCLK1_INV and GCLK2_INV may also be idled to help conserve power.

Although the methods of operations are described in a specific order, it should be understood that other operations may be performed in between described operations, described operations may be adjusted so that they occur at slightly different times or described operations may be distributed in a system which allows occurrence of the processing operations at various intervals associated with the processing, as long as the processing of the overlay operations are performed in a desired way.

The foregoing is merely illustrative and various modifications can be made by those skilled in the art without departing from the scope and spirit of the described embodiments. The foregoing embodiments may be implemented individually or in any combination.

What is claimed is:

1. A display, comprising:

a pixel;

a scan driver circuit configured to generate a scan signal; and a scan inverter circuit configured to receive the scan signal from the scan driver circuit and to invert the scan signal to generate a corresponding inverted scan signal that is conveyed to the pixel, wherein the scan inverter circuit comprises:

a first transistor having a gate terminal configured to receive the scan signal from the scan driver circuit; and second and third transistors coupled in series between a source terminal of the first transistor and a power supply terminal, wherein the second and third transistors are configured to reduce an amount of leakage through the first transistor.

2. The display of claim 1, wherein the scan inverter circuit further comprises:

a fourth transistor that is coupled between the first transistor and the power supply terminal and that has a gate terminal configured to receive the scan signal from the scan driver circuit.

3. The display of claim 1, wherein the scan inverter circuit further comprises:

an additional power supply terminal on which an additional power supply voltage that is different than the power supply voltage is provided;

a fourth transistor coupled in series between the additional power supply terminal and the first transistor.

4. The display of claim 3, wherein the scan inverter circuit further comprises:

a fifth transistor coupled between the additional power supply terminal and a drain terminal of the first transistor, wherein the fourth and fifth transistors have gate terminals configured to receive a clock signal.

5. The display of claim 1, wherein the pixel has a semiconducting-oxide transistor having a gate terminal configured to receive the inverted scan signal from the scan inverter circuit.

6. The display of claim 5, wherein the display is operable at a refresh rate that is less than 30 Hz, and wherein the second and third transistors are configured to minimize a drain-to-source voltage across the first transistor during blanking times.

7. The display of claim 1, wherein the second transistor has a source terminal coupled to the source terminal of the first transistor and has a gate terminal coupled to a drain terminal of the first transistor.

8. The display of claim 7, wherein the third transistor has a source terminal coupled to a drain terminal of the second transistor and has a drain terminal coupled to the power supply terminal.

9. The display of claim 1, wherein the third transistor has a source terminal coupled to a drain terminal of the second transistor and has a gate terminal coupled to an output of the scan inverter circuit.

10. The display of claim 9, wherein the scan inverter circuit further comprises:

an additional power supply terminal on which an additional power supply voltage that is different than the power supply voltage is provided; and fourth and fifth transistors coupled in series between the output of the scan inverter circuit and the additional power supply terminal.

11. The display of claim 10, further comprising:

a sixth transistor having a source terminal connected to a source terminal of the fourth transistor and a gate terminal connected to the output of the scan inverter circuit.

12. The display of claim 11, further comprising:

a seventh transistor having a source terminal connected to a drain terminal of the sixth transistor and having a gate terminal connected to the output of the scan inverter circuit.

13. The display of claim 1, further comprising:

an enable transistor coupled between the scan driver circuit and the scan inverter circuit, wherein the enable transistor is turned off to allow the scan driver circuit and the scan inverter circuit to operate independently.

14. Display circuitry, comprising:

a pixel; and a gate driver circuit configured to output a control signal to the pixel, wherein the gate driver comprises:

a first power supply line on which a first power supply voltage is provided;

a second power supply line on which a second power supply voltage is provided;

a first transistor having a gate terminal configured to receive a scan signal, a first source-drain terminal coupled to the first power supply line, and a second source-drain terminal coupled to the second power supply line;

a second transistor having a gate terminal configured to receive the scan signal, a first source-drain terminal coupled to the second source-drain terminal of the first transistor, and a second source-drain terminal coupled to the second power supply line; and a leakage reduction circuit having a first terminal directly connected to the second source-drain terminal of the first transistor and to the first source-drain terminal of the second transistor and having a second terminal coupled to the first power supply line.

15. The display circuitry of claim 14, wherein the leakage reduction circuit further includes a third terminal directly connected to the first source-drain terminal of the first transistor.

16. The display circuitry of claim 15, wherein the leakage reduction circuit further includes a third terminal directly connected to an output of the gate driver circuit on which the control signal is provided.

17. The display circuitry of claim 14, wherein the leakage reduction circuit further includes a third terminal directly connected to an output of the gate driver circuit on which the control signal is provided.

18. A display, comprising:

a pixel;

a scan driver circuit configured to output a scan signal;

a scan inverter circuit configured to receive the scan signal and to output a corresponding inverted scan signal to the pixel; and an enable transistor coupled between the scan driver circuit and the scan inverter circuit, wherein the enable transistor is turned on during a first scan mode when the scan driver circuit and the scan inverter circuit operate at the same rate and is turned off in a second scan mode when the scan driver circuit and the scan inverter circuit operate independently at different rates.

* * * * *